US006681853B2

(12) United States Patent
Doyle et al.

(10) Patent No.: US 6,681,853 B2
(45) Date of Patent: Jan. 27, 2004

(54) DOWNHOLE ANTI-ROTATION TOOL

(75) Inventors: John P. Doyle, Calgary (CA); Lynn P. Tessier, Cochrane (CA); James L. Weber, Calgary (CA)

(73) Assignee: MSI Machineering Solutions Inc., Calgary (CA)

( * ) Notice: Subject to any disclaimer, the term of this patent is extended or adjusted under 35 U.S.C. 154(b) by 168 days.

(21) Appl. No.: 09/962,105

(22) Filed: Sep. 26, 2001

(65) Prior Publication Data

US 2002/0014335 A1 Feb. 7, 2002

Related U.S. Application Data

(63) Continuation-in-part of application No. 09/517,555, filed on Mar. 2, 2000, now Pat. No. 6,318,462.

(51) Int. Cl.[7] ..... E21B 23/01

(52) U.S. Cl. ..... 166/214; 166/206; 166/241.1; 166/216; 166/242.1

(58) Field of Search ..... 166/117.7, 206, 166/214, 216, 217, 241.1, 241.6, 241.7, 242.1, 382; 175/73

(56) References Cited

U.S. PATENT DOCUMENTS

| | | | | |
|---|---|---|---|---|
| 1,617,303 A | | 2/1927 | Dougherty | |
| 2,038,262 A | | 4/1936 | Bernhardt | |
| 2,665,888 A | | 1/1954 | Claypool et al. | |
| 2,819,039 A | | 1/1958 | Lindsay et al. | |
| 3,296,900 A | | 1/1967 | Behnke | |
| 3,322,006 A | | 5/1967 | Brown | |
| 3,380,528 A | | 4/1968 | Timmons | |
| 3,382,929 A | | 5/1968 | Plunk | |
| 3,977,473 A | * | 8/1976 | Page, Jr. | 166/382 |
| 4,085,804 A | * | 4/1978 | Page, Jr. | 166/382 |
| 4,416,339 A | | 11/1983 | Baker et al. | |
| 4,499,799 A | | 2/1985 | Bordages | |
| 4,640,354 A | * | 2/1987 | Boisson | 166/250.01 |
| 4,669,555 A | | 6/1987 | Petree | |
| 4,739,843 A | | 4/1988 | Burton | |
| 4,811,785 A | | 3/1989 | Weber | |
| 4,886,130 A | | 12/1989 | Evans | |
| 4,901,793 A | | 2/1990 | Weber | |
| 5,275,239 A | | 1/1994 | Obrejanu | |
| 5,623,991 A | | 4/1997 | Jani | |
| 5,636,690 A | | 6/1997 | Garay | |
| 5,909,770 A | | 6/1999 | Davis | |
| 6,041,859 A | | 3/2000 | Blades | |
| 6,073,693 A | | 6/2000 | Aldridge | |
| 6,189,610 B1 | * | 2/2001 | LaClare et al. | 166/208 |
| 6,318,462 B1 | | 11/2001 | Tessier | |
| 6,464,013 B2 | * | 10/2002 | Bystedt | 166/380 |

FOREIGN PATENT DOCUMENTS

| | | |
|---|---|---|
| CA | 1274470 | 9/1990 |

* cited by examiner

*Primary Examiner*—George Suchfield
(74) *Attorney, Agent, or Firm*—Sean W. Goodwin

(57) ABSTRACT

A tool is provided for preventing the rotation of a downhole tool or rotary pump stator, the tool comprising a tubular housing and a jaw which is biased radially outwardly from the tool to engage the casing wall for arresting tool rotation and providing significant stabilization of a rotary pump. In doing so, the tool housing moves oppositely to rest against the casing opposite the jaw. The tool housing and the downhole tool are thereby restrained and stabilized by the casing wall. The tool's jaw is released by opposite tool rotation. Preferably, the jaw is biased outwardly from the tool housing to a casing-engaging position by a torsional member, housed along the axis of the hinge of the jaw. The tool is released from the casing by opposite tool rotation which increasingly compresses the jaw toward the housing, twisting the torsional member into torsion, which then acts to urge the jaw outwardly again.

23 Claims, 10 Drawing Sheets

1
2
3
4
5
7
8
9
10
11
12
13
14
30

DOWNHOLE ANTI-ROTATION TOOL

CROSS REFERENCE TO RELATED APPLICATION

This application is a continuation-in-part of pending U.S. patent application Ser. No. 09/517,555 filed on Mar. 2, 2000, now U.S. Pat. No. 6,318,462 the entirety of which is incorporated herein by reference.

FIELD OF THE INVENTION

The invention relates to a tool for preventing rotation of a tubing string or progressive cavity pump in the bore of a casing string.

BACKGROUND OF THE INVENTION

Oil is often pumped from a subterranean reservoir using a progressive cavity (PC) pump. The stator of the PC pump is threaded onto the bottom of a long assembled string of sectional tubing. A rod string extends downhole and drives the PC pump rotor. Large reaction or rotor rotational forces can cause the tubing or PC pump stator to unthread, resulting in loss of the pump or tubing string.

Anti-rotation tools are known including Canadian Patent No. 1,274,470 to J. L. Weber and U.S. Pat. No. 5,275,239 to M. Obrejanu. These tools use a plurality of moving components, slips and springs to anchor and centralize the PC Pump stator in the well casing.

Further, the eccentric rotation of the PC Pump rotor imposes cyclical motion of the PC Pump stator, which in many cases is supported or restrained solely by the tool's slips. Occasionally a stabilizing tool is added to dampen or restrain the cyclical motion to failure of the anti-rotation tool.

SUMMARY OF THE INVENTION

A simplified anti-rotation tool is provided, having only one jaw as a moving part but which both prevents rotation and stabilizes that to which it is connected. In simplistic terms, the tool connects to a progressive cavity (PC) pump or other downhole tool. Upon rotation of the tool in one direction a jaw, which is biased outwardly from the tool housing, engages the casing wall to arrest tool rotation. This action causes the tool housing to move oppositely and come to rest against the casing opposing the jaw. The tool housing and the downhole tool are thereby restrained and stabilized by the casing wall.

In a broad apparatus aspect, an anti-rotation tool comprises: a tubular housing having a bore and having at least one end for connection to a downhole tool and a jaw having a hinge and a radial tip. The jaw is pivoted at its hinge from one side of the housing, so that the jaw is biased so as to pivot outwardly to a first casing-engaging position, wherein the radial tip engages the casing, and the housing is urged against the casing opposite the jaw. The jaw is also inwardly pivotable to a second compressed position towards the housing to enable movement within the casing during tripping in and tripping out.

Preferably, the jaw is biased to the casing-engaging position by a torsional member extending through the hinge, which is rigidly connected to the housing at a first end and to the jaw at a second end. Compression of the jaw twists the torsional member into torsion which then acts to bias or urge the jaw outwardly again.

Preferably, the swing of the jaw is arranged for tools having conventional threaded connections wherein the jaw is actuated under clockwise rotation and is compressed by counter clockwise rotation of the tool.

More preferably, the jaw is formed separately from the housing so that the housing and bore remain independent and the bore can conduct fluid.

DETAILED DESCRIPTION OF THE PREFERRED EMBODIMENT

Figures 1A, 1B, 1C, 2:
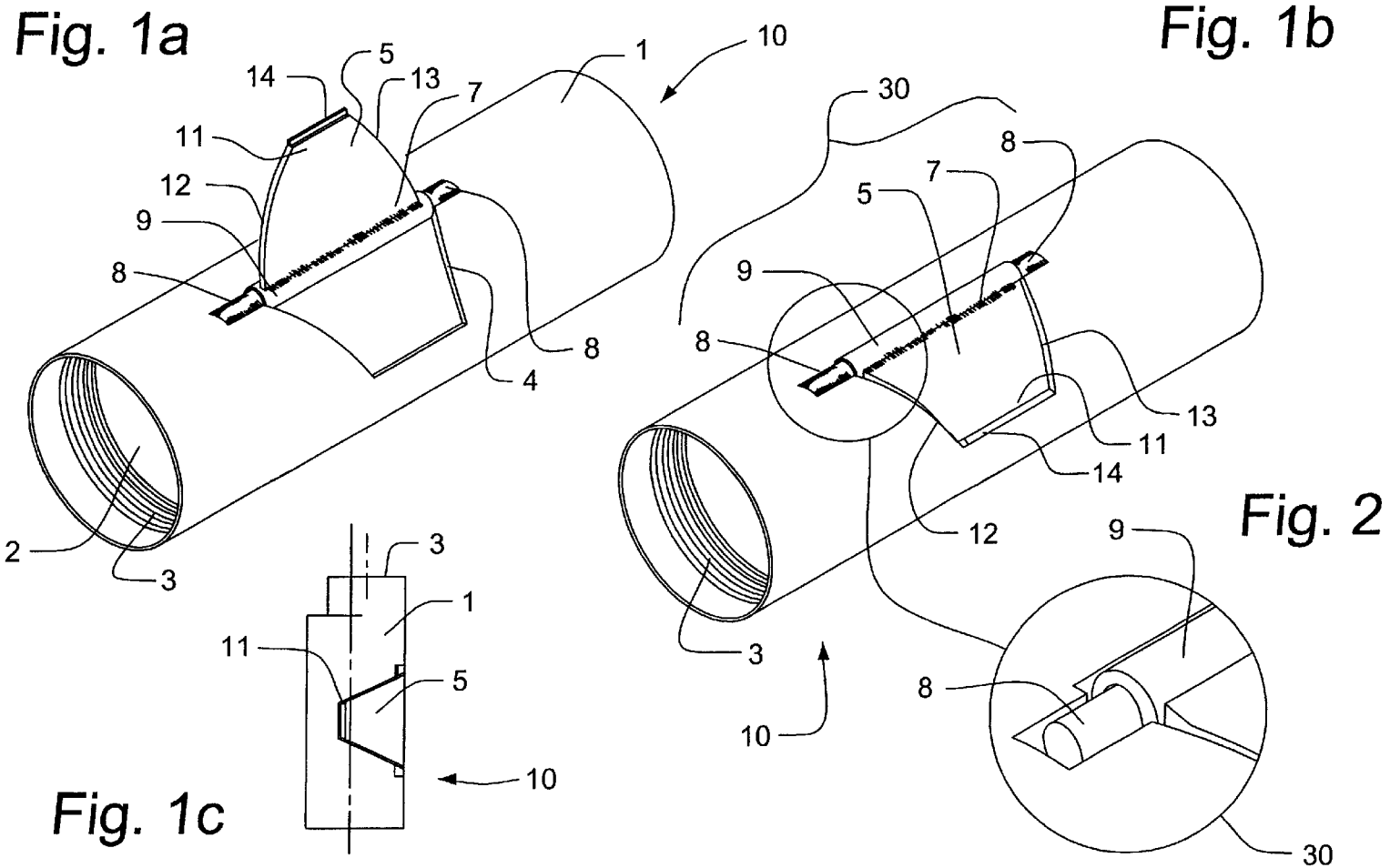
FIGS. 1*a* and 1*b* are isometric views of one embodiment of the tool showing the jaw with its radial tip in its extended position (FIG. 1*a*) and the stored position (FIG. 1*b*)
FIG. 1*c* is a side view of an optional housing embodiment in which the threaded portion has its center offset from the housing center.
FIG. 2 is an enlarged view of the hinge pin, inset into the housing before welding to the housing.
Figure 5A:
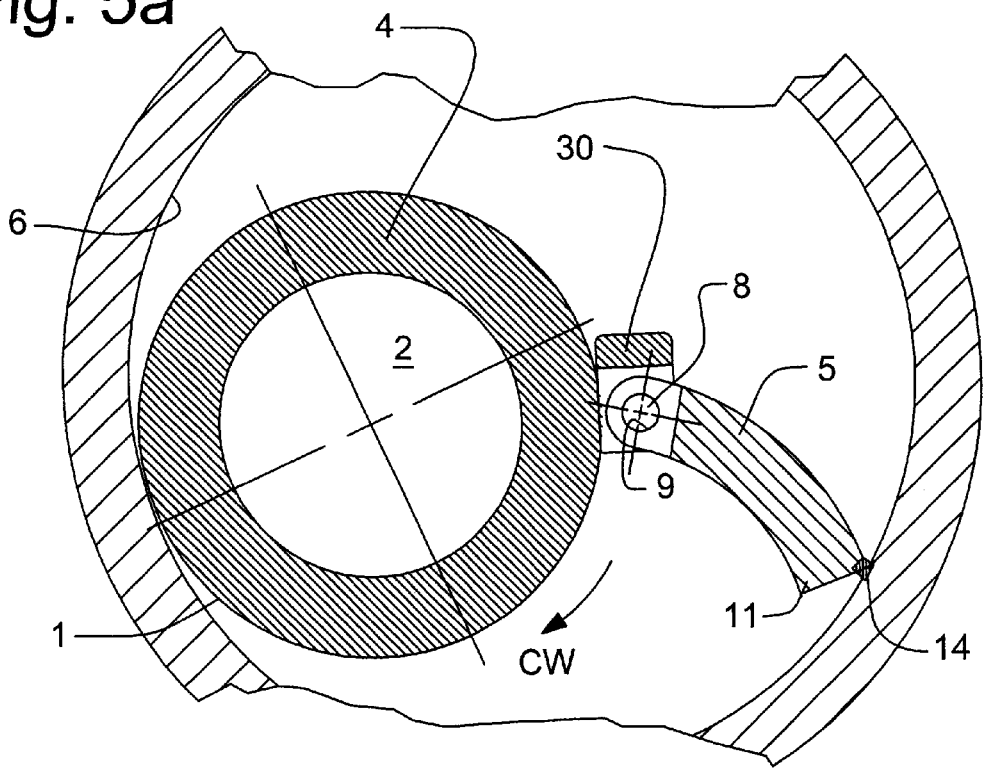
FIGS. 5*a* and 5*b* are cross sectional views of the tool according to FIG. 4, viewed through the hinge with the jaw open and engaging the casing (FIG. 5*a*) and closed for installation (FIG. 5*b*).

Having reference generally to FIGS. 1*a*, 1*b*, 5*a*, and 5*b*, a tool 10 is provided for preventing rotation relative to casing 6 in a wellbore. The tool 10 comprises a tubular housing 1 with a bore 2. The bore 2 has at least one threaded end 3 for connection to a downhole tool such as the bottom of a PC pump (not shown). A jaw 5 is pivotably mounted to the housing I and swings between a stowed position (FIGS. 1*b*, 5*b*) and a casing-engaging position (FIGS. 1*a*, 5*a*).

In a first embodiment, as illustrated in FIGS. 1*a*–3*b*, the jaw 5 pivots out of the housing, interrupting the housing and opening the bore to the wellbore. As a variation of the first embodiment, a second embodiment demonstrates a specialized housing which centralizes the bore in the wellbore, as illustrated in FIG. 1*c*. In a third embodiment, an alternate arrangement of the jaw is shown which does not compromise the tool's housing or bore.

Figure 3A:
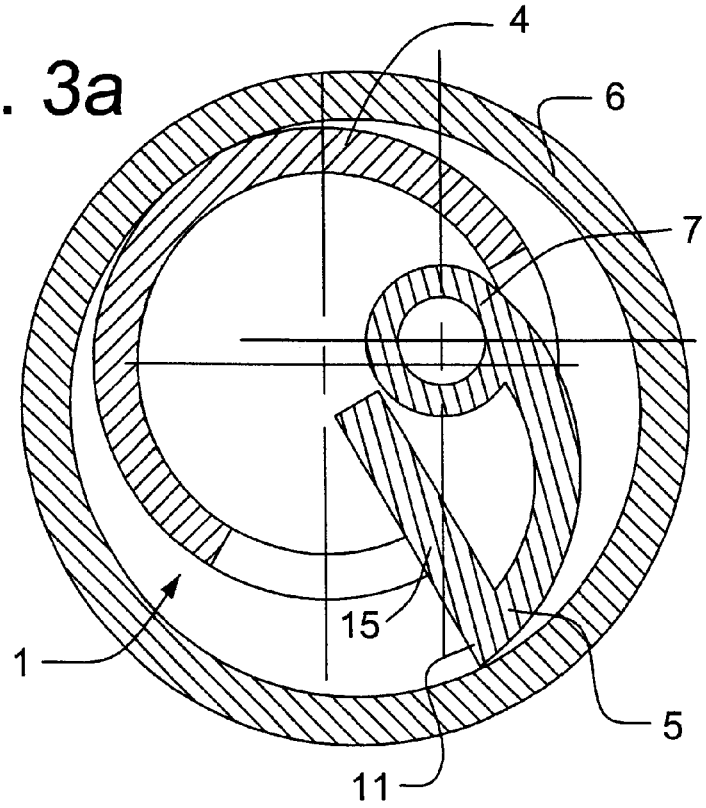
FIGS. 3*a* and 3*b* are cross sectional views of the tool through the hinge, illustrating the jaw open and engaging the casing (FIG. 3*a*) and closed for installation (FIG. 3*b*)
Figure 3B:
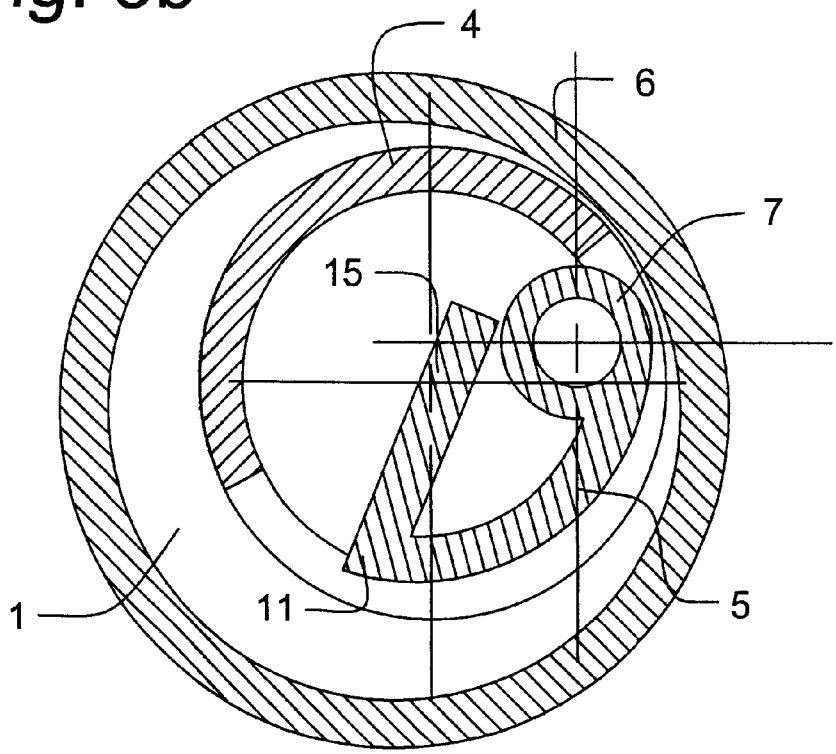

More particularly, in the first embodiment and having reference to FIGS. 1*a*, 1*b*, 3*a* and 3*b* a portion of the housing wall 4 is cut through to the bore 2 to form a trapezoidal flap or jaw 5. The jaw 5 has an arcuate profile, as viewed in cross-section, which corresponds to the curvature of the housing wall 4. Accordingly, when stowed, the jaw 5 projects minimally from the tubular housing 1 and avoids interfering with obstructions while running into the casing 6 (FIG. 3*b*).

Referring to FIGS. 1*a*–2, the jaw 5 is pivoted to the housing 1 along a circumferential edge 7 at hinge 30. The jaw 5 has a radial tip edge 11.

Hinge 30 comprises tubing 9 welded to the hinge edge 7 with a pin 8 inserted therethrough. Pin 8 is welded to the housing wall 4 at its ends. In a mirrored and optional arrangement (not shown), the jaw's hinge edge 7 has axially projecting pins and the housing wall is formed with two corresponding and small tubular sockets for pinning the pins to the housing and permitting free rotation of the jaw therefrom.

The hinge edge 7 and hinge 30 are formed flush with the tubular housing wall 4.

The running in and tripping out of the tool 10 is improved by using a trapezoidal jaw 5, formed by sloping the top and bottom edges 12, 13 of the jaw 5. The hinge edge 7 is longer than the radial tip edge 11. Accordingly, should the radial tip 11 swing out during running in or tripping out of the tool 10, then incidental contact of the angled bottom or top edges 12, 13 with an obstruction causes the jaw 5 to rotate to the stowed and non-interfering position.

The jaw's radial tip 11 can have a carbide tip insert 14 for improved bite into the casing 6 when actuated.

If the wall thickness of the jaw 5, typically formed of the tubular housing wall 4, is insufficient to withstand the anchoring stress, then a strengthening member 15 can be fastened across the chord of the radial tip 11 to the hinge edge 7.

The strengthening member 15 can include, as shown in FIGS. 3*a*, 3*b*, a piece of tool steel or the equivalent which substitutes for the carbide insert.

In operation, the tool 10 is set by clockwise rotation so that the jaw 5 rotates out as an inertial response and is released simply by using counter-clockwise rotation. Specifically, as shown in FIG. 3*b*, when the tool is rotated counter-clockwise as viewed from the top, the jaw's radial tip edge 11 rotates radially inwardly and becomes stowed flush with the housing wall 4, minimizing the width or effective diameter of the tool 10. Conversely, as shown in FIG. 3*a*, when the tool 1 is rotated clockwise as viewed from the top, the jaw 5 rotates radially outwardly from the housing 1, increasing the effective diameter of the tool 10, and the radial tip engages the casing 6. Further, the housing 1 is caused to move in an opposing manner and also engages the casing 6 opposite the jaw 5, the effective diameter being greater than the diameter of the casing 6.

Significant advantage is achieved by the causing the tool's housing 1 and its associated downhole tool (PC Pump) to rest against the casing 6. The casing-engaged jaw 5 creates a strong anchoring force which firmly presses the tool housing 1 and the PC Pump stator into the casing 6. Accordingly, lateral movement of the PC Pump is restricted, stabilizing the PC Pump's stator against movement caused by the eccentric movement of its rotor. It has been determined that the stabilizing characteristic of the tool 10 can obviate the requirement for secondary stabilizing means.

Referring back to FIG. 1*c*, in an optional second embodiment, the threaded end 3 can be formed off-center to the axis of the housing 1, so that when the radial tip 11 engages the casing 6, the axis of the threaded end 3 is closer to the center of the casing 6 than is the axis of the housing 1. This option is useful if the PC Pump or other downhole tool requires centralization.

In the first and second embodiment, the jaw 5 is conveniently formed of the housing wall 4, however, this also opens the bore 2 to the wellbore. If the tool 10 threaded to the bottom of a PC Pump, this opening of the bore 2 is usually irrelevant. However, where the bore 2 must support differential pressure, such as when the PC Pump suction is through a long fluid conducting tailpiece, or the tool 10 is secured to the top of the PC Pump and must pass pressurized fluids, the bore 2 must remain sealed.

Figure 4:
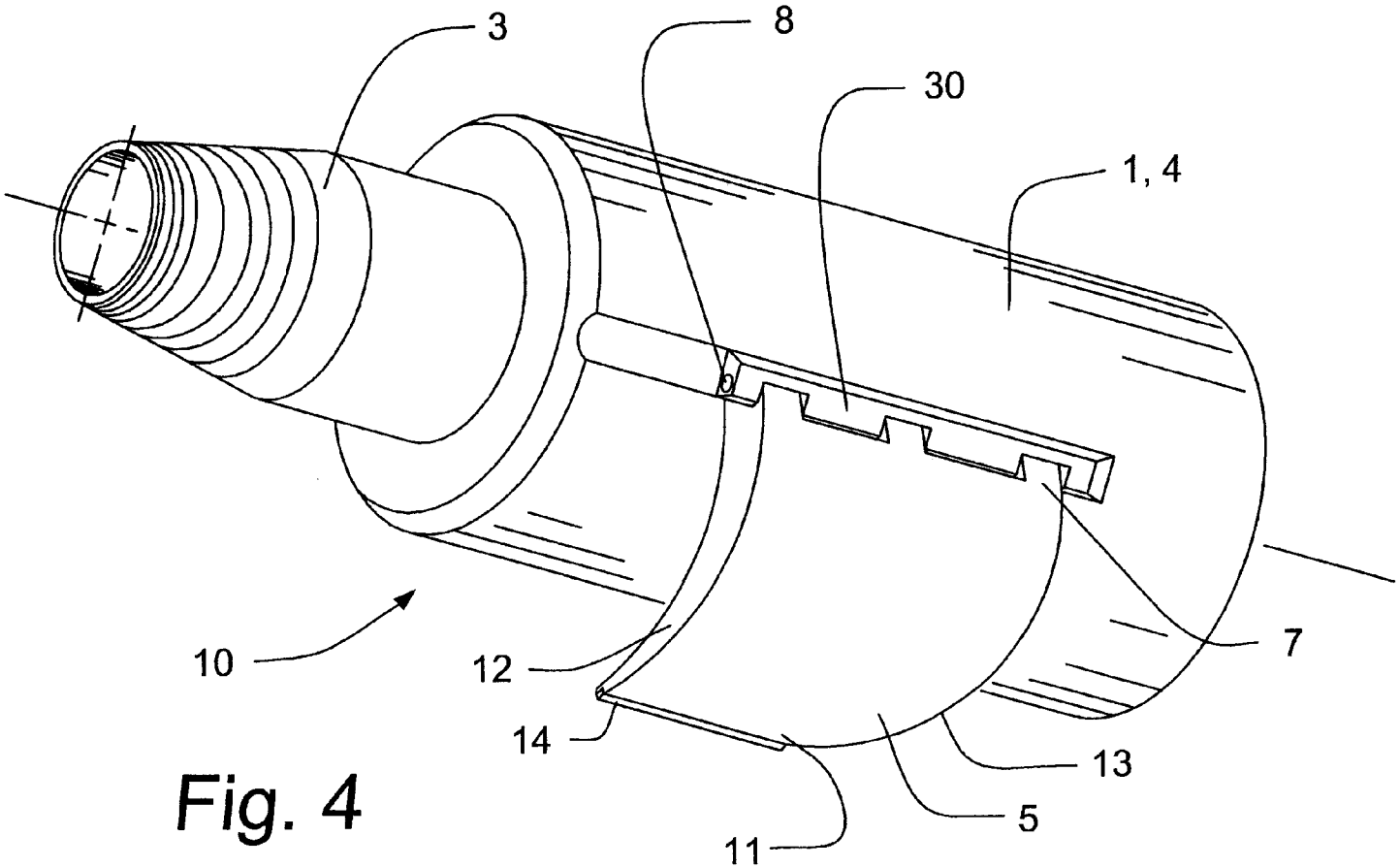
FIG. 4 is an isometric view of a third embodiment of the tool showing the jaw with its radial tip in its extended position.
Figure 5B:
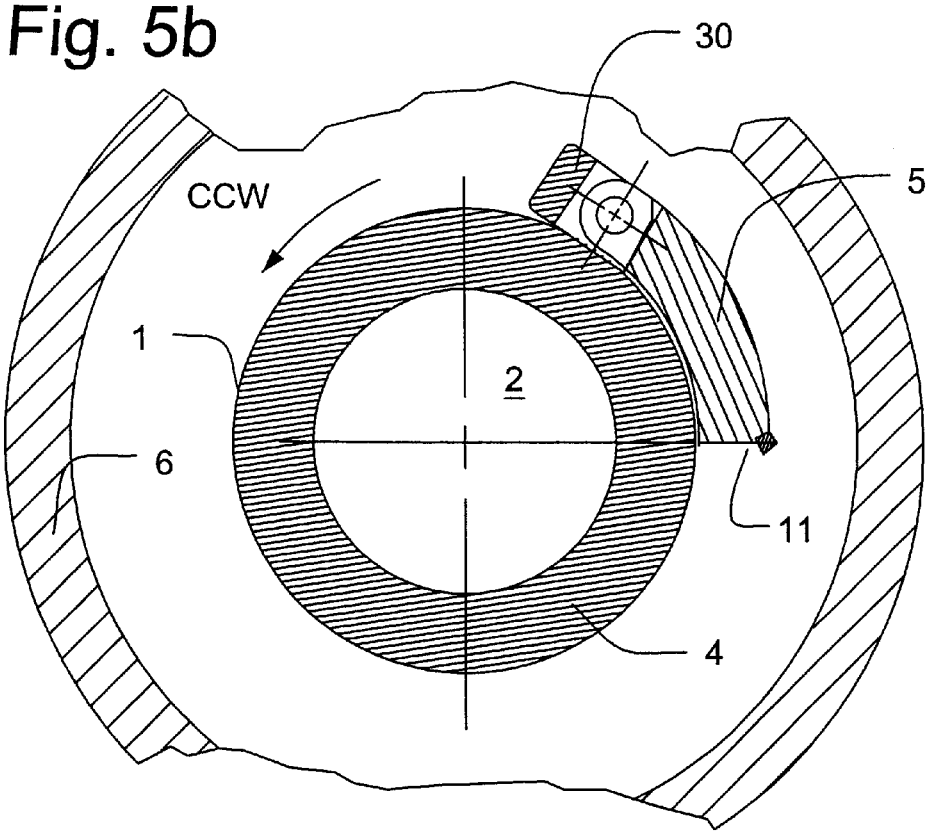

Accordingly, and having reference to FIGS. 4–5*b*, in a third embodiment, the housing wall 4 is not interfered with so that the bore 2 remains separate from the wellbore. This is achieved by mounting the jaw 5 external to the housing 1. The profile of jaw 5 conforms to the housing wall 4 so as to maintain as low a profile as possible when stowed (FIG. 5*b*).

More specifically as shown in FIG. 4, as was the case in the first embodiment, the profile of the jaw 5 corresponds to the profile of the housing wall 4. In this embodiment however, the jaw 5 is pivoted along its circumferential edge 7 at a piano-type hinge 30 mounted external to the housing wall 4. Corresponding sockets 9 are formed through the circumferential edge of the jaw and the hinge 30. Pin 8 is inserted through the sockets 9. A carbide insert 14 is fitted to the radial tip edge 11 of the jaw 5.

In operation, as shown in FIG. 5*a*, if the tool 1 is rotated clockwise as viewed from the top, the radial tip edge 11 of the jaw rotates radially outwardly from the housing and the carbide insert 14 engages the casing 6. The housing wall 4 moves and also engages the casing 6, opposite the jaw 4 for anchoring and stabilizing the tool. As shown in FIGS. 3*a* and 5*a*, the overall dimension of the extended jaw 5 and the housing 1 is greater than the diameter of the casing 6 so that contact of the radial tip edge 11 with the casing 6 forces the housing against the casing opposing the jaw.

As shown in FIG. 5*b*, if the tool is rotated counter-clockwise as viewed from the top, the jaw's radial tip edge 11 rotates radially inwardly and becomes stowed against the housing wall 4.

Having reference to FIGS. 6*a*–11*b*, in a fourth embodiment, a novel jaw 105 is provided, which is biased outwardly from the housing 1. The jaw 105 is pivotally connected to wall of the housing 1 with a hinge 107, the hinge 107 having first and second ends 113, 114 and which lies along a rotational axis. The jaw 105 comprises a tubular conduit 120, having first and second ends 109, 110, formed along edge 106, which co-operates with a linearly extending, flexible torsional member 121, shown as having a rectangular section, to bias hinge 107 and jaw 105 outwardly from the housing 1. The torsional member or spring 121 extends through the tubular conduit 120 and is attached to the tool housing 1 using a first hinge spring holder 122, and to the jaw 105 using a second hinge spring holder 123. A preferred hinge utilizes a coupled pin and cavity arrangement at each end of the jaw 105.

One of either the first or second spring holders 122, 123 rigidly connects a first end 124 of the hinge spring 121 to the housing 1, preventing it from rotating with the pivoting jaw 105. The other spring hinge holder 123, 122 rotatably connects a second end 125 of the hinge spring 121 to the housing 1, causing it to rotate therein, with the jaw 105. Accordingly, as the jaw 105 is rotated from the outwardly extending position to a more compressed position, the hinge spring 121 is twisted into torsion.

Figures 6A, 6B:
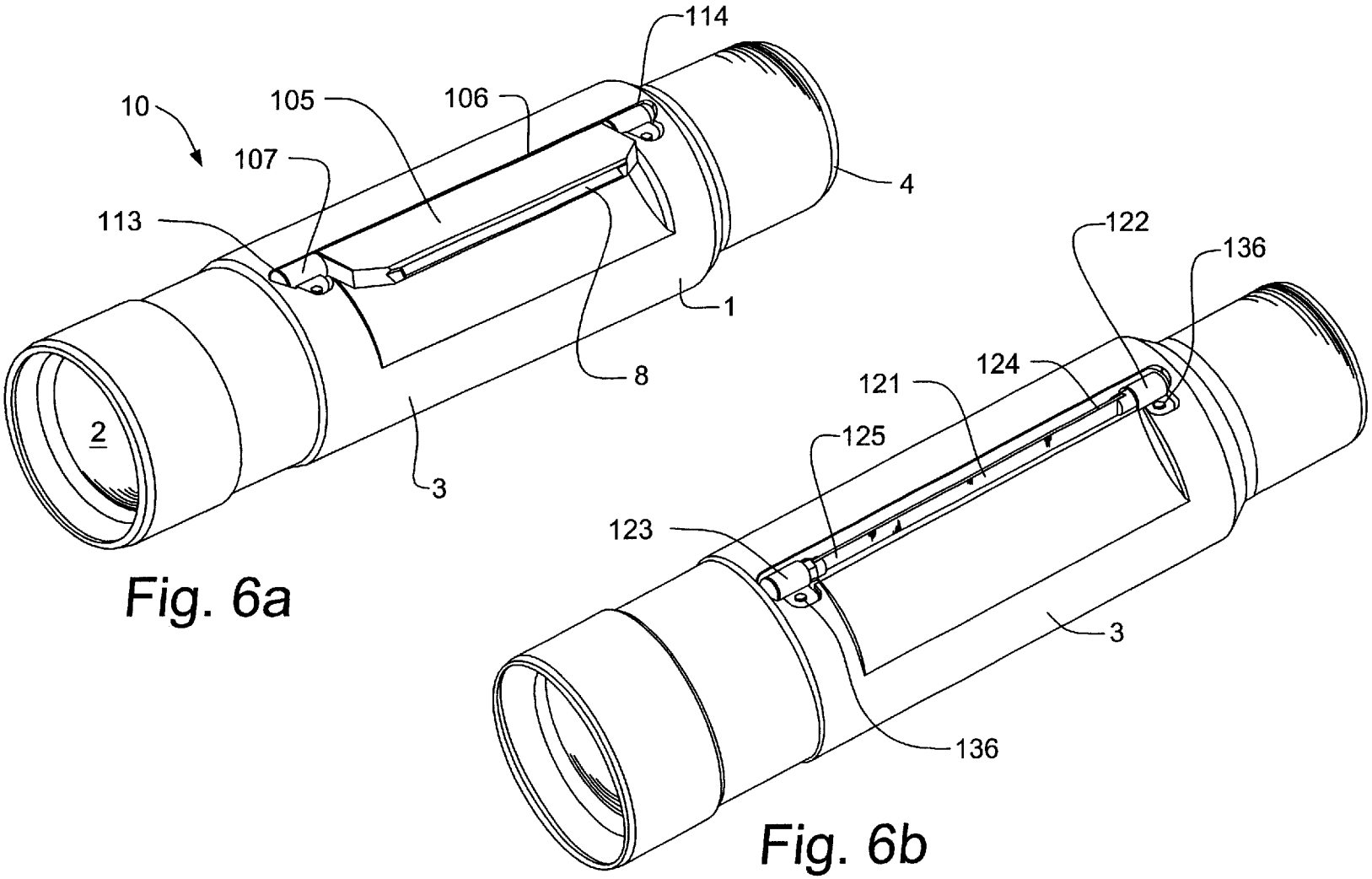
FIG. 6*a*, is an isometric view of another embodiment of the anti-rotation tool of the present invention showing the jaw with its radial tip in its extended position.
FIG. 6*b* is an isometric view according to FIG. 6*a* with the jaw removed to show the orientation of a hinge spring in the extended position.
Figure 7:
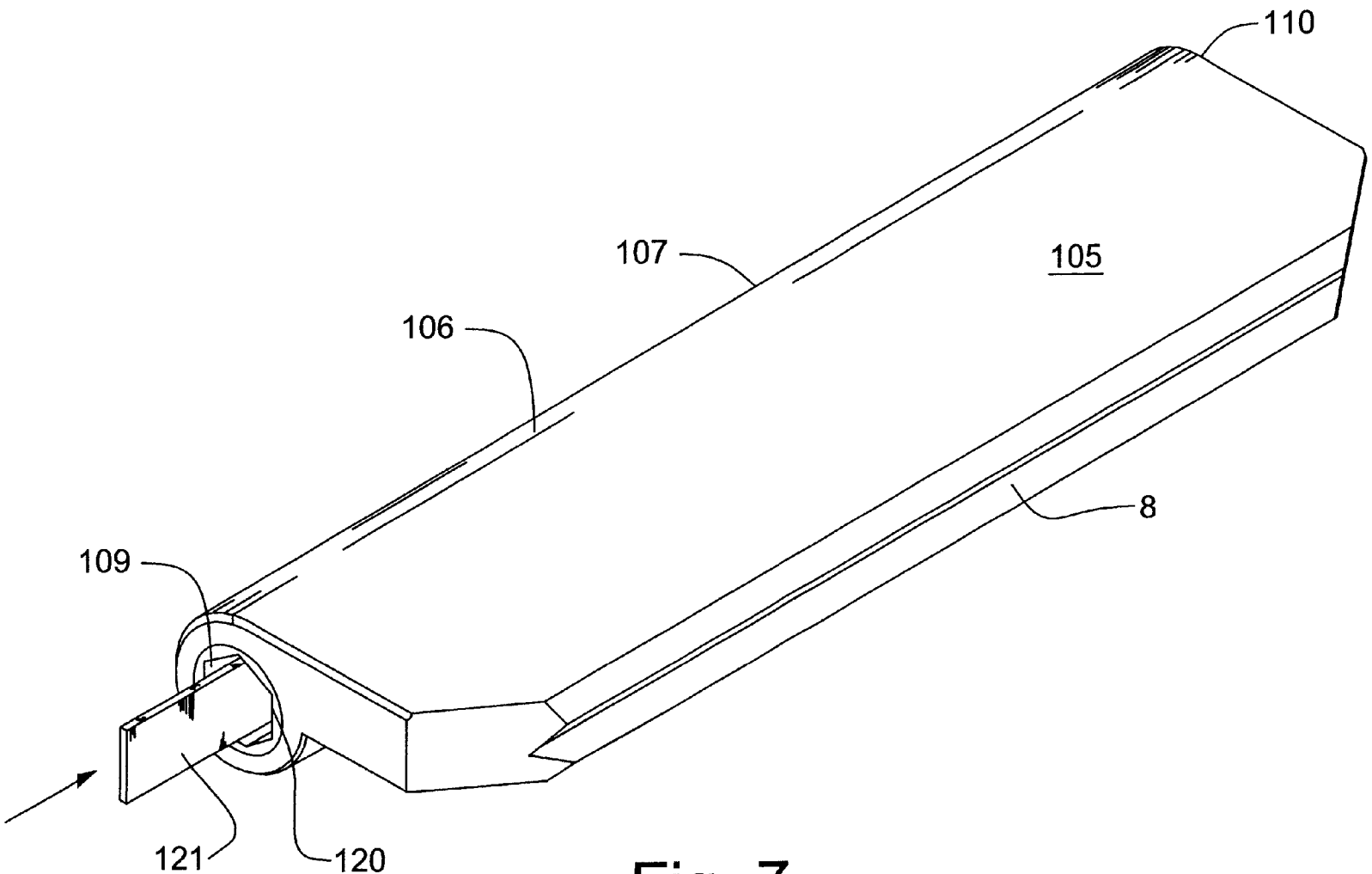
FIG. 7 is a perspective view of the jaw of FIG. 6*a*, removed from the housing.
Figure 8:
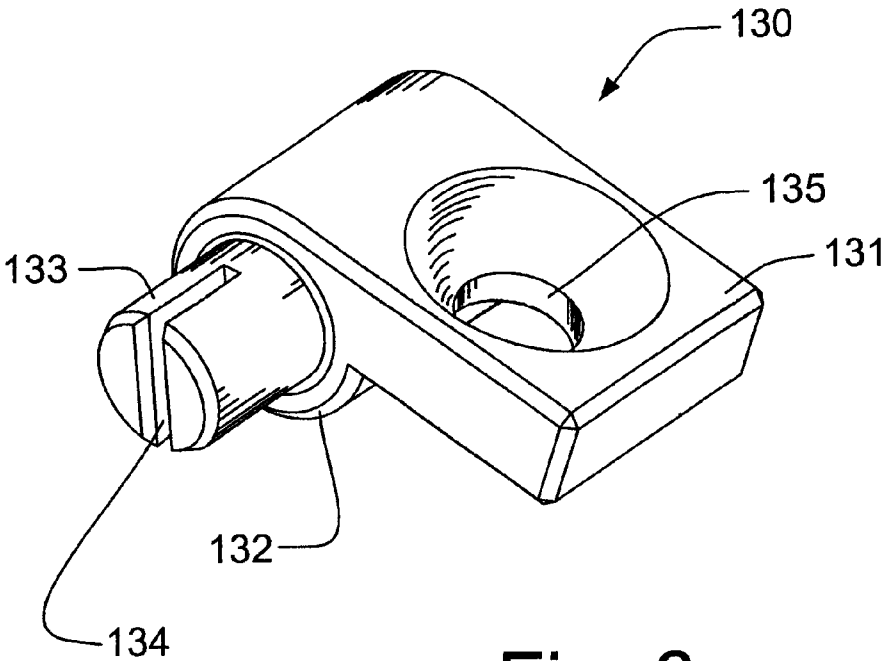
FIG. 8 is a perspective view of a stationary hinge spring holder according to FIG. 6*a;*

As shown in FIGS. 6*b* and 8, a first stationary spring holder 130, fixes the spring's first end 124 to the tool housing 1. The stationary spring holder 130 comprises a body 131 having a tubular shaped edge 132, corresponding to the tubular conduit 121 of the jaw 105. The body 131 further comprises a counter-sunk screw hole 135 for attaching the stationary holder 130 to the housing 1, using a suitable fastener 136. A cylindrical retaining pin 133 extends outwards from the holder's tubular edge 132, along the same axis, for insertion into the cavity of the jaw's tubular conduit 120. A spring-retaining slot 134 is formed in the retaining pin 133 for engaging the hinge spring's first end 124. The orientation of the slot 134 relative to the pin 133 is such that when the stationary holder 130 is affixed to the housing 1, the jaw 105 is biased to the outwardly extending position.

Figure 9:
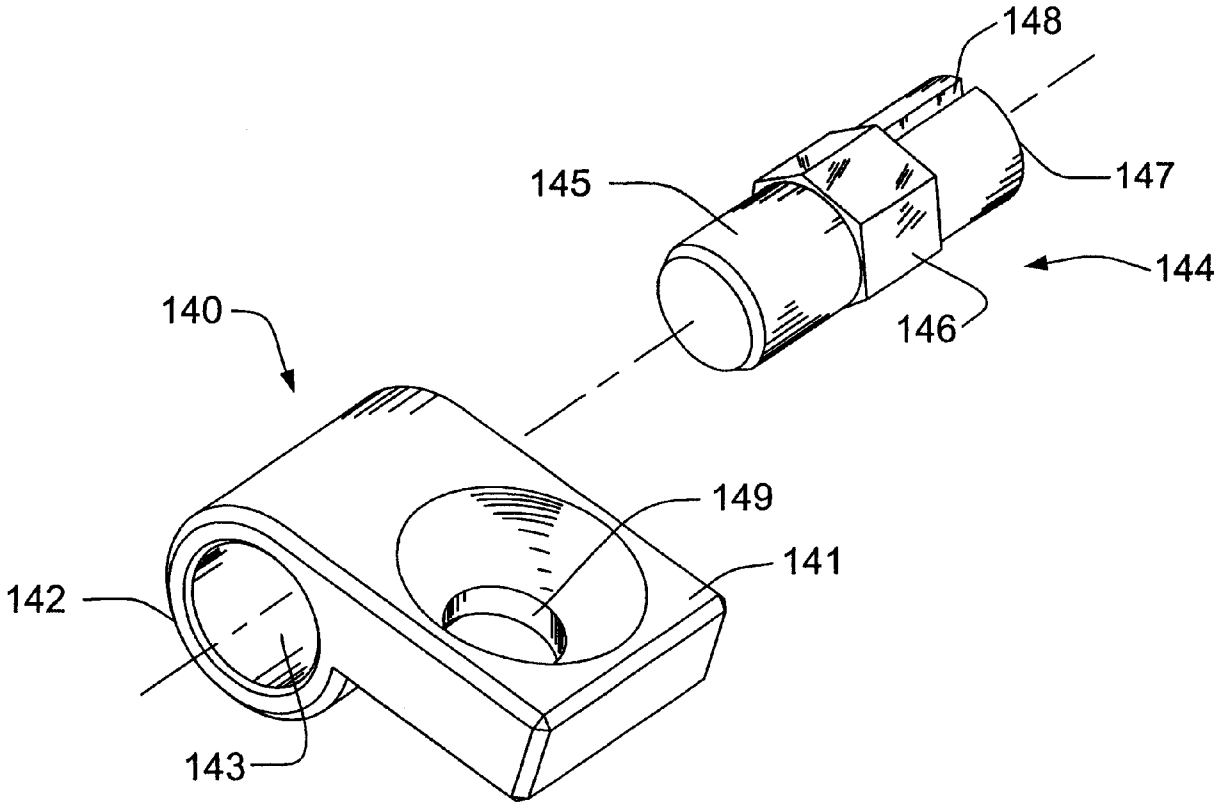
FIG. 9 is a perspective view of a rotational hinge spring holder and retaining pin according to FIG. 6*a;*

Having reference to FIGS. 6*b* and 9, a second rotating spring holder 140 is shown, which fixes the spring 121 to the jaw 105. The rotating holder 140 comprises a body 141 having a tubular edge 142, corresponding to the jaw's tubular conduit 120. The tubular edge 142 has a bore 143. The body 141 further comprises a counter-sunk screw hole 149 for attachment of the holder 140 to the housing 1, using a suitable fastener 136. A connector body 144 comprises a first end or retaining pin 145, which extends into the cavity or bore 143 for free rotation therein, enabling pivoting of the hinge 107. The connector body 144 further comprises a profiled middle portion 146 (such as an oval or polygonal shape; hexagonal shown) which is inserted into and co-operates with a correspondingly profiled first end 109 of the jaw's conduit 120, to rotationally fix connector body 144 to the jaw 105. Lastly the connector body 144 has a spring-retaining end 147. The spring retaining end 147 further comprises a slot 148 for retaining the hinge spring's second end 125.

Figures 10A, 10B:
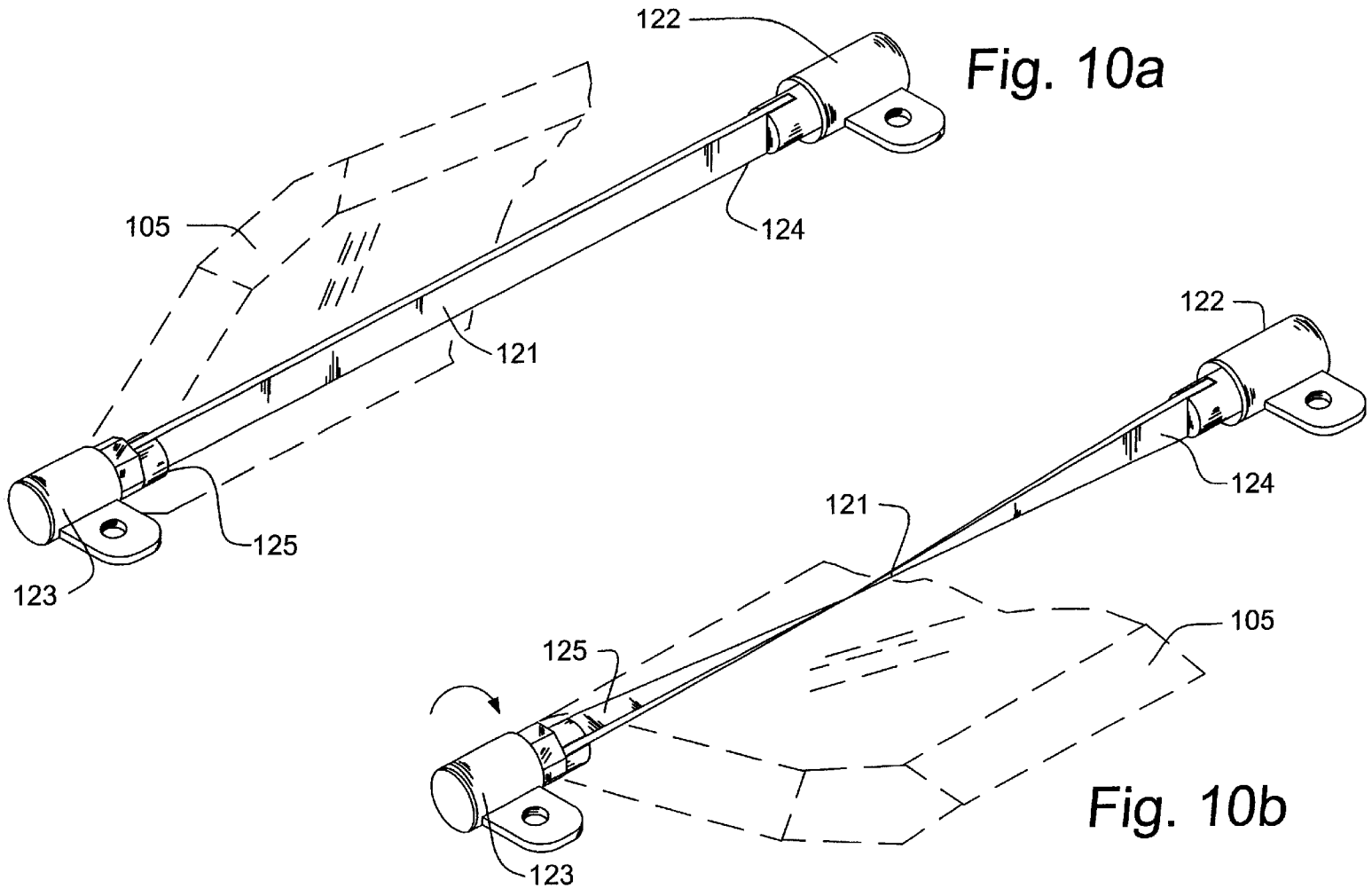
FIG. 10*a* is a perspective view of the hinge spring and first and second end spring holders showing their respective orientation when the jaw has been biased to its to extended position.
FIG. 10*b* is a perspective view of the hinge spring and first and second end spring holders showing their respective orientation when the jaw is urged against the spring to the closed position.

As shown in FIG. 10*a*, the hinge spring 121 attached to the housing 1 and the jaw 105 (partially shown-hidden lines) is oriented with the first and second ends 124, 125 in the same plane, biasing the jaw 105 to the open outwardly extending position as a result of the orientation of the spring 121 relative to the stationary hinge spring holder 122. Further, showing the spring action in greater detail in FIG. 10*b*, when the jaw 105 (hidden lines) is urged to a more compressed position, the stationary holder 122 retains the spring's first end 124 orientation, however, the rotating spring holder 123 allows the spring's second end 125 to be rotated with the jaw 105. Rotation of the spring's second end 125, as the jaw 105 is compressed, twists the spring 121 into torsion. As soon as the force causing the jaw 105 to pivot to the compressed position is released, the spring 121 biases the jaw 105 to return the jaw 105 to the casing-engaging position once again. Further, the preferred construction of the hinge 107 avoids supporting loads imposed on the jaw 105 when in the casing-engaging position. The jaw's conduit 120 and the bore 143 of the rotational spring holder are both oversized relative to their respective retaining pins 133, 145, allowing limited lateral movement of the jaw 105 relative to the housing I without interfering with the jaw's pivoting action. Accordingly, when the jaw is in the outwardly extended, casing engaging position, the reaction on the jaw 105 drives the jaw sufficiently into the housing 1 so that the back of the tubular conduit 120 at edge 106 engages the housing 1, transferring substantially all of the forces directly from the jaw 105 to the housing 1, and avoiding stressing of the retaining pins 133, 145 and spring holders 122, 123.

Figure 11B:
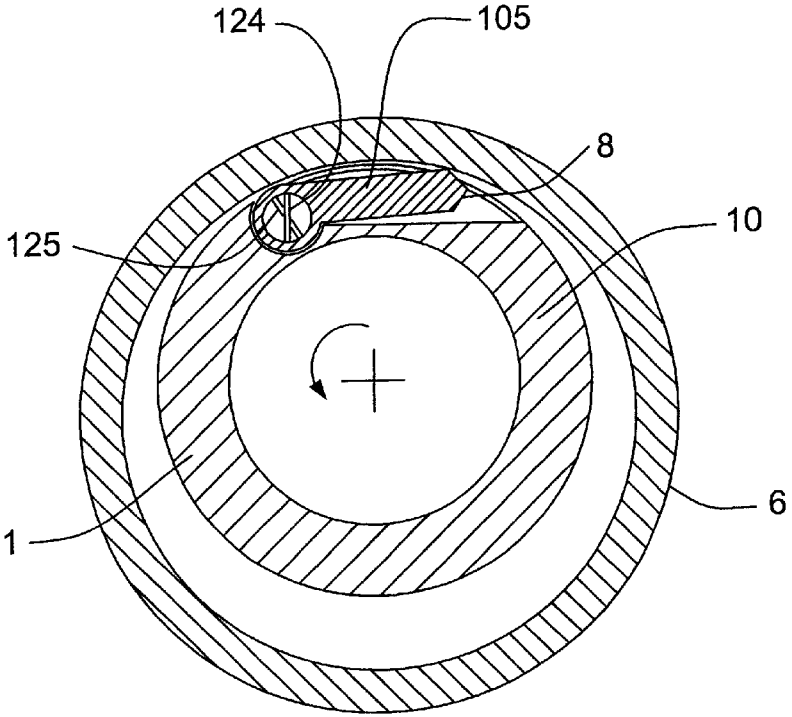
FIGS. 11*a* and 11*b* are cross sectional views of the tool through the hinge, illustrating the jaw open and engaging the casing and showing the ends of the hinge spring substantially aligned at the first and second spring holders (FIG. 10*a*) and then compressed for tripping in and tripping out (FIG. 10*b*), showing the ends of the hinge spring out of plane as the hinge spring is in torsion.
Figure 11A:
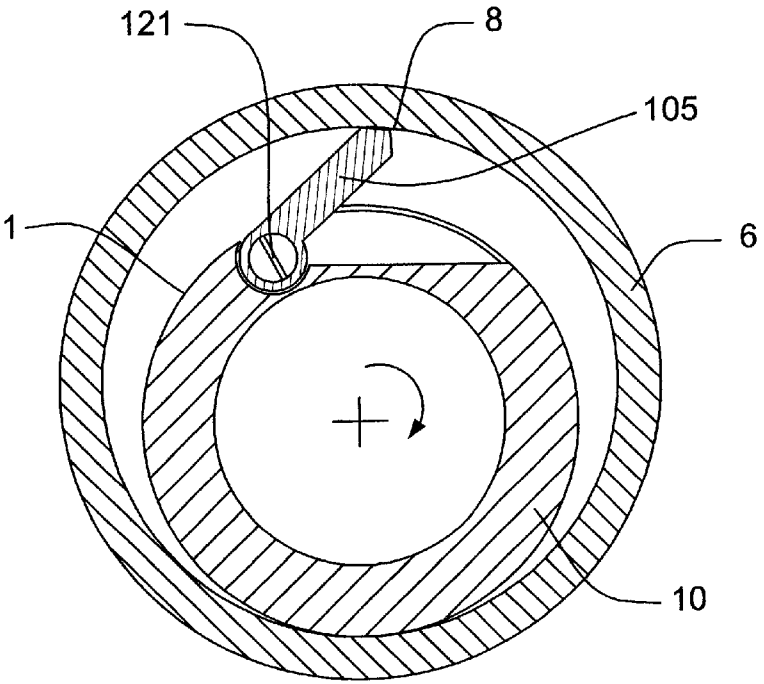

In operation, as shown, viewed from the top, in FIGS. 11*a* and 11*b*, the tool 10 is set into a casing 6 by clockwise rotation with the jaw 105 in the biased open position and is released from the casing 6 simply by using counter-clockwise rotation, contact of the jaw 105 and casing to compressing the jaw 105 towards the housing 1. Specifically, as shown in FIG. 11*b*, when the tool 10 is rotated counter-clockwise, the interaction of the jaw 105 and casing 6 causes the jaw to pivot inwardly towards the housing 1, minimizing the width or effective diameter of the tool 10. The inward rotation of the jaw 105 causes the hinge spring's rotational end 125 to rotate relative to the hinge spring's stationary end 124, putting the hinge spring 121 into torsion. Conversely, as shown in FIG. 11*a*, when the jaw 105 is not being compressed, such as when the tool 10 is at rest or when rotated clockwise, the jaw 105 is biased outwardly by the hinge spring 121 to return to the outwardly extending casing-engaging position, increasing the effective diameter of the tool 10. The radial tip 8 engages the casing 6 and the housing 1 is caused to move in an opposing manner so as to engage the casing 6 and brace itself opposite the jaw 105, the effective diameter being greater than the diameter of the casing 6.

The embodiment of the invention in which an exclusive property or privilege is claimed are defined as follows:

1. A tool to prevent rotation of a downhole tool suspended in a wellbore casing comprising:

a tubular housing having a wall for engaging the casing and having at least one end for connection to the downhole tool;

a jaw having a radial tip and which is rotatable along an axis along a wall of the housing opposing the casing engaging wall for varying the effective diameter of the tool, and a spring, acting between the jaw and the housing so as to bias the jaw outwardly to a first casing-engaging position wherein the radial tip is positioned outwardly from the housing to increase the tool's effective diameter so that the radial tip engages the casing and the housing wall engages the casing for arresting tool rotation and further, to permit a second compressed position wherein the jaw is temporarily compressed towards the housing for minimizing the tool's effective diameter and permitting movement within the casing.

2. The tool as described in claim 1 wherein the spring is a member connected rigidly to the housing at a first end and connected to the jaw at a second end so as to actuate the spring upon rotation of the second end relative to the first.

3. The tool as described in claim 2 wherein the jaw is rotatable about a hinge having first and second ends and extending substantially along a rotational axis of the jaw and wherein the spring is a torsional member connected to the housing adjacent the hinge's first end and to the jaw at the hinge's second end, so as to cause the torsional member to twist into torsion as a result of force acting upon the jaw.

4. The tool as described in claim 1 wherein the jaw is trapezoidal in shape having sloped top and bottom edges so that the jaw is caused to rotate to the compressed position if contacted by an obstruction in the wellbore during running in and tripping out.

5. The tool as described in claim 1 wherein the radial tip has an insert to improve bite into the casing when in the casing-engaging position.

6. The tool as described in claim 1 wherein the housing has a bore which is maintained separate from the wellbore.

7. The tool as described in claim 1 wherein the housing is substantially disengaged from the casing when the jaw is in the compressed position.

8. The tool as described in claim 3 wherein at the hinge there is sufficient movement of the jaw relative to the hinge to permit the jaw to engage the housing and transfer substantially all of the force directly to the housing, minimizing force on the hinge.

9. The tool as described in claim 8 wherein the hinge further comprises a first retaining pin and a first cavity at the first end of the hinge and a second retaining pin and second cavity at the second end of the hinge.

10. The tool as described in claim 9 wherein the first and second cavities are oversized relative to the pins to permit sufficient movement of the jaw to engage the housing and transfer substantially all of the force directly to the housing, minimizing force on the hinge.

11. The tool as described in claim 10 further comprising:

a first holder is connected to the first retaining pin for pinning a first end of the torsional member to the housing; and a second holder pivotable with the jaw is connected to the second retaining pin for pinning a second end of the torsional member to the jaw so that when the jaw rotates inwardly towards the housing, the torsional member is twisted into torsion for biasing the jaw outwardly.

12. The tool as described in claim 3 further comprising:

a first holder for pinning a first end of the torsional member to the housing; and a second holder pivotable with the jaw and for pinning a second end of the torsional member to the jaw so that when the jaw rotates inwardly towards the housing, the torsional member is twisted into torsion for biasing the jaw outwardly.

13. The tool as described in claim 12 wherein:

the torsional member is a linearly extending member;

the first holder is a member fastened to the housing and having a slot for accepting the first end of the torsional member; and the second holder is a member:

i) rotatable with the jaw and having a slot for accepting the second end of the torsional member; and ii) pivotally connected to the housing.

14. The tool as described in claim 13 wherein:

the second end of the jaw has a cavity having a profile; and the second holder has a profile which is compatible and insertable into the jaw's profiled cavity for co-rotation therewith.

15. The tool as described in claim 14 wherein the profile is polygonal in shape.

16. The tool as described in claim 14 wherein the cavities are oversized relative to the retaining pins to permit sufficient movement of the jaw to permit the jaw to engage the housing for transferring substantially all of the force directly to the housing, minimizing the force on the retaining pins.

17. A tool to prevent rotation of a downhole tool suspended in a wellbore casing comprising:

a tubular housing having a wall for engaging the casing and having at least one end for connection to the downhole tool;

a jaw having a radial tip and which is rotatable from a point on the housing opposing the casing engaging wall for varying the effective diameter of the tool, and a hinge, acting between the jaw and the housing so as to permit the jaw to rotate between a first outwardly extending casing-engaging position wherein the radial tip is positioned outwardly from the housing to increase the tool's effective diameter so that the radial tip engages the casing and the housing wall engages the casing for arresting tool rotation and a second compressed position wherein the jaw is temporarily compressed towards the housing for minimizing the tool's effective diameter and permitting movement within the casing, the hinge connected to the housing so as to permit sufficient movement of the jaw relative to the hinge to permit the jaw to engage the housing and transfer substantially all of the force directly to the housing, minimizing the force on the hinge, the hinge having a linearly extending flexible torsional member connected rigidly to the housing at a first end and connected to the jaw at a second end so as to twist the member into torsion upon rotation of the second end relative to the first; and a tubular conduit having first and second ends extending along an edge of the jaw for accepting the torsional member.

18. The tool as described in claim 17 further comprising:

a first cylindrical retaining pin insertable into the tubular conduit at the first end for permitting relative rotation between the first and second ends of the torsional member; and a second retaining pin having a profile which is compatible and insertable into the second end of the tubular conduit for co-rotation therewith.

19. The tool as described in claim 18 wherein the tubular conduit is oversized relative to first and second retaining pins so as to permit sufficient movement of the jaw to permit the jaw to engage the housing and transfer substantially all of the force directly to the housing, minimizing the force on the retaining pins.

20. An improvement to a tool used to prevent rotation of a downhole tool suspended in a wellbore casing, the tool having a housing and at least one jaw having an edge which is pivotable at a hinge on the housing, the hinge having first and second ends pivotally connected to the housing, the improvement comprising:

a torsional member having first and second ends; and a first holder for pinning the first end of the torsional member to the housing; and a second holder pivotable with the jaw and for pinning the second end of the torsional member to the jaw so that when the jaw pivots towards the housing, the torsional member is twisted for biasing the jaw outwardly.

21. The improvement of claim 20 wherein:

the torsional member is a linearly extending member, extending along a length of the hinge;

the first holder is a member fastened to the housing and having a slot, the slot accepting a first end of the torsional member; and the second holder is a member rotatable with the jaw and having a slot for accepting a second end of the torsional member.

22. The improvement of claim 21 wherein the torsional member extends through a tubular conduit formed along a length of the jaw from the hinge's first end to the hinge's second end.

23. The improvement of claim 21 wherein:

the second end of the jaw has a cavity having a profile; and the second holder is a member having a profile which is compatible and insertable into the jaw's profiled cavity for co-rotation therewith.

* * * * *